US005197733A

United States Patent [19]

Schroder

[11] Patent Number: 5,197,733

[45] Date of Patent: Mar. 30, 1993

[54] GOLF CLUB

[76] Inventor: Edward W. Schroder, 37832 N. Laurel Park Dr., Livonia, Mich. 48152

[21] Appl. No.: 633,263

[22] Filed: Dec. 24, 1990

[51] Int. Cl.[5] ..... B01D 27/04; A63B 53/02; A63B 53/06

[52] U.S. Cl. ..... 273/80 C; 273/79; 156/293

[58] Field of Search ..... 273/80.2–80.9, 273/80 C, 81.3, 167 G, 79; 156/293

[56] References Cited

U.S. PATENT DOCUMENTS

| | | | |
|---|---|---|---|
| 1,983,158 | 12/1934 | Young | 273/80.4 |
| 3,166,320 | 1/1965 | Onions | 273/80 C |
| 3,966,210 | 6/1976 | Rozmus | 273/80 C |

*Primary Examiner*—George J. Marlo
*Attorney, Agent, or Firm*—Jerry G. Beck

[57] ABSTRACT

A golf club comprises a club head and a shaft. The club head is provided with a striking face and a bored hole that extends from the upper heel portion of the club head inwardly in the general direction of the center of percussion of the club head. The shaft has a main elongated shaft portion and a lower shaft portion that is angularly offset from the main elongated shaft portion. The lower shaft portion is received in the bored hole to allow for the assembly of the shaft to the club head. The bored hole is positioned so that a vertical plane passing through the center axis of the lower shaft portion received in the bored hole is parallel to a second vertical plane passing through a horizontal line that is tangent to the center of the striking face of the club head. During assembly of the shaft to the club head to the shaft, rotation of the main elongated shaft portion will swivel the club head about the center axis of the lower shaft portion to allow the face angle of the striking face to be set to a desired select position before the shaft is firmly bonded to the club head.

5 Claims, 3 Drawing Sheets

GOLF CLUB

BACKGROUND OF THE INVENTION

The present invention relates to golf clubs that have improved performance due to their unique construction and design of the interconnection of the golf club head and the golf club shaft which replaces the hosel of conventional golf clubs of the prior art. In particular, longer golf clubs commonly referred to as woods are provided with a striking face having a face angle and a loft angle to direct the golf ball when the striking face of the club head of the golf club, upon being swung by the golfer, impacts the golf ball. The club head has a center of percussion which is located in the center of club head at which point the full effect of the mass of the club head is concentrated. The center of percussion transposed to the striking face is called the "sweet spot" in golfer's language. A golfer tries to hit the golf ball as close to the "sweet spot" as possible to gain greater accuracy and distance for the hit golf ball. The shaft is usually received within the hosel of the club head. The hosel of the conventional club head is integrally formed with the club head to provide a long-necked portion that extends upwardly at an angle for several inches from the upper surface of the heel portion of the club head. The hosel has a straight hole extending along its center axis which receives the bottom end of the elongated shaft. The shaft is bonded to the hosel by an adhesive. Usually, hosels of wood club designs are reinforced with a tightly wound thread. The shaft is received in the hole of the hosel at an angle of about 55 degrees with the horizontal ground plane when the club head is resting on the ground and the golf club held by the golfer in a ready-to-swing position. U.S. Pat. No. 1,515,390 depicts the shaft being received in the hosel.

The center axis of the shaft in the hole of the hosel is substantially rearward of the center of percussion as seen in FIG. 6 of U.S. Pat. No. 3,625,518 of the prior art. The radial distance from the center of percussion to the center axis of the shaft is approximately one inch (2.54 cm.) which creates a couple effect that reacts radially when the golf ball is struck by the golf club head. This distance results in a force couple which has to be overcome or compensated for by the club head design or by manipulation by the golfer of the club shaft. In golf club heads, a corresponding counter balanced mass of material must be provided radially opposite the lower portion of the shaft and its support material which includes the hosel. The further away these masses are from the center of percussion, the greater the effect they have on the golf ball when it is impacted by the golf club head, especially when the golf ball is hit off-center by the golfer.

SUMMARY OF THE INVENTION

In the present invention, the golf club head and the lower portion of the shaft are of an improved construction to impart greater accuracy and distance to the golf ball upon being impacted by the golf club. The golf club head and shaft construction are modified in this invention to differentiate from conventional golf clubs of the prior art by moving the lower portion of the shaft and its support material substantially closer to the center of percussion of the club head, thereby reducing the force couple of the mass of material and its corresponding counterbalance mass radially opposite. In turn, greater control of the golf ball flight is achieved when hit by the golf club of this invention. The protruding hosel of the conventional wood golf club head is either eliminated or substantially shortened in the golf club of the present invention to materially reduce the frontal area of the golf head. This results in a lower wind drag coefficient when the golf club is swung resulting in increased club head speed and ball flight distance.

The golf club head of this invention has a hole extending inwardly from the upper surface of the rear or heel portion of the club head at an angle of approximately 40 degrees with the horizontal ground plane so that it passes close to the center of percussion or "sweet spot" of the club head.

In a preferred embodiment of this invention, a foreshortened neck is provided with a metal ring encompassing the neck to reinforce it at the entry of the lower portion of the shaft into the bored hole of the club head. The lower portion of the shaft is bent to angularly offset it by about 10 to 15 degrees from the main elongated portion of the shaft. The center axis of the main elongated portion of the shaft makes an angle of about 55 degrees with the horizontal ground line similar to conventional angle of lie as in most present state-of-the-art golf clubs. The upper end of the main elongated portion of the shaft is provided with a grip to permit the golfer to grasp the golf club. The lower portion of the shaft can be integrally formed with a main elongated portion of the shaft or, as in the preferred embodiment of this invention, the lower portion of the shaft incorporates a sleeve encompassing all or part of the lower segment of the shaft. This reinforces the shaft at the point where it forms a juncture with the club head.

Another feature of this invention is that the bent shaft allows the face angle of the striking face of the club head to be set at the time of assembly of the club head and the shaft. Further, this face angle can be changed by breaking the adhesive and resetting the angle to a new position. This greatly improves the condition of the present practice of having to machine or mold in the face angle into the club head at the time of manufacture which then becomes permanent. When the face angle is fixed, it may be at an incorrect setting for the golfer who then attempts to make compensations for the incorrect face angle by altering his grip, stance, or make other adjustments to control the flight of the golf ball.

With the present invention, it is possible to establish the desired face angle either in an open or closed position by simply rotating the shaft with its angular offset lower portion in the hole of the club head before the shaft is permanently bonded to the club head. When the shaft is rotated slightly in either direction, the face angle will move to an open or closed position, depending on direction of rotation of the shaft.

After insertion of the lower portion of the shaft coated with an adhesive into the hole slight, rotation of the shaft at the grip will result in the club head supported on a flat surface to slightly swivel about the forwardmost part of the club head 12, which is usually at or near the center of the striking face 17, so as to change its face angle. At the desired face angle position, the golf club is held in a fixed position until the adhesive has bonded. The face angle may be manually reset by breaking the adhesive bond and repeating the procedure.

Among the objectives of the present invention are to provide golf clubs, especially those referred to as "woods" with an improved performance as the force applied to the swing of the golf club will be more effectively utilized to hit the golf ball by reducing force couple reactions radially located about the point of impact of the golf ball with the club head.

A further objective is to allow the golfer to choose the face angle of the club head to suit his own particular requirements by rotating the shaft in the club head to the desired face angle before the shaft is permanently bonded to the club head.

These and other objectives will become more apparent with reference to the accompanying drawings and following specifications which illustrate the various embodiments of the present invention.

DESCRIPTION OF THE PREFERRED EMBODIMENTS

Figure 1:
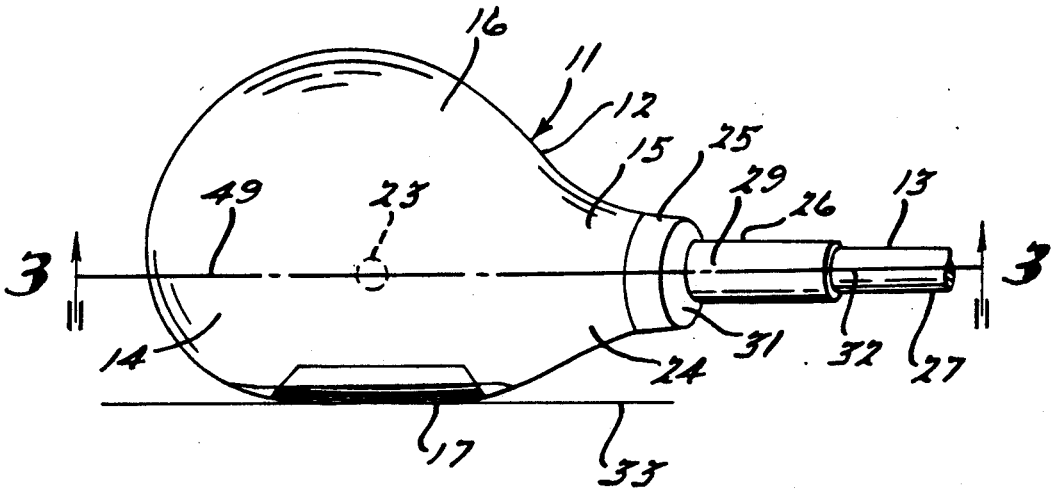
FIG. 1 is a top view of a golf club embodying the teachings of the present invention.
Figure 2:
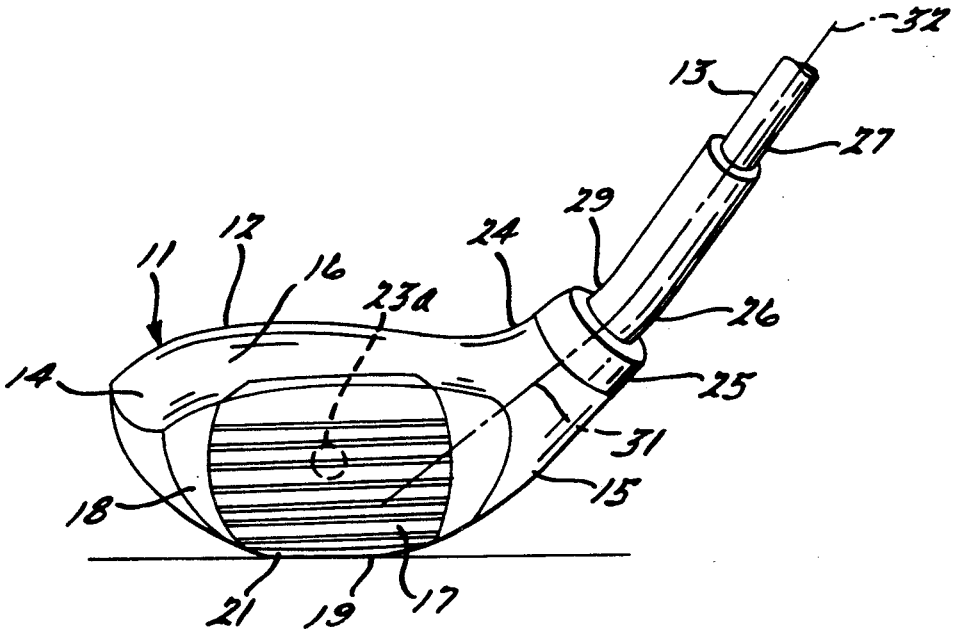
FIG. 2 is a frontal view of the golf club of FIG. 1.

Referring to FIGS. 1 and 2, top and frontal views of a golf club 11 of this invention are shown. The golf club 11 has golf club head 12 and a shaft 13, although not shown completely, terminates in a conventional grip to allow the golfer to grasp the golf club 11. The club head 12 preferably for this invention is a "wood" that is cut from a solid wood block such as persimmon or could be manufactured of metal or plastic. The club head 12 could also be cast from metal and machined as an "iron" but the advantage of this invention is more apparent when applied to "woods".

The club head 12 has a toe portion 14 and a heel portion 15 and is integrally formed with an upper surface 16 contiguous with the toe portion 14 and heel portion 15. A generally convex-curved striking face 17 is provided at the frontal surface of the club head 12 as best seen in FIG. 2. A partial elliptical insert 18 is recessed in the striking face 17. This insert 18 is usually fabricated from a special high energy material to improve the interaction of the golf ball and the club head 12 when contact is made.

The club head 12 also has a bottom surface 19 usually provided with a sole plate 21 to protect the club head 12 when it strikes the ground at ground level 22.

Figure 3:
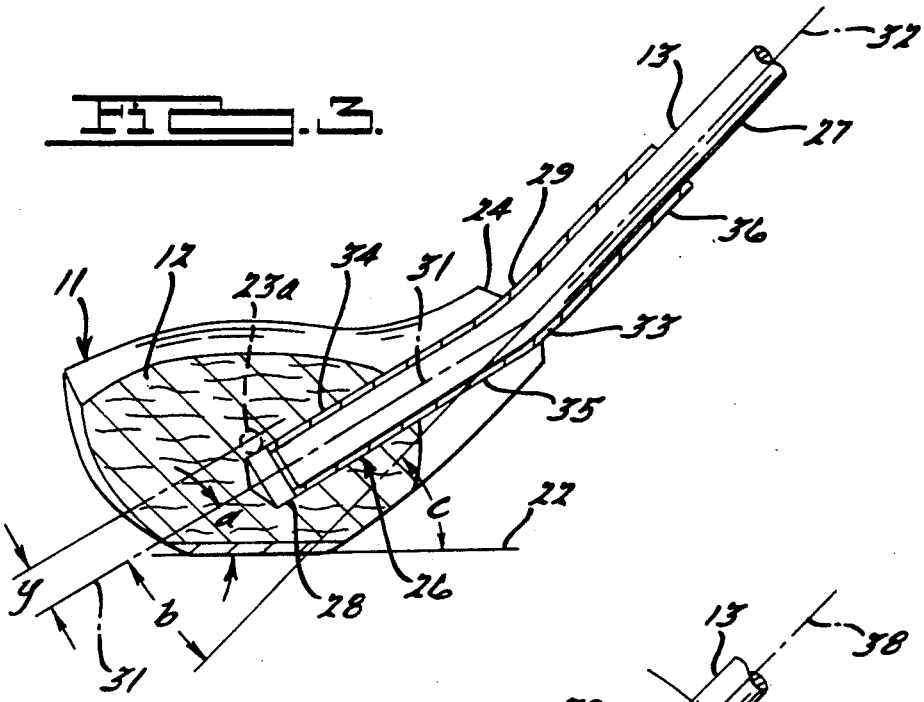
FIG. 3 is a sectional view taken along line 3—3 of FIG. 1.

Each club head 12 has a center of percussion 23 at the center of the club head 12 where the maximum mass of the club head is concentrated. The "sweet spot" 23*a* shown as a dotted circle in FIGS. 2 and 3 is the center of percussion 23 of the club head 12 transposed to the striking face 17. Each golfer tries to hit the golf ball as close to the "sweet spot" 23*a* as possible to obtain maximum accuracy and distance.

In FIGS. 1, 2 and 3, a preferred embodiment of this invention is shown. The club head 12 is provided with a short neck 24 extending upwardly and rearwardly from the upper surface 16 at the heel portion 15. A metal ring 25 encompasses the stub end of the neck 24 to provide reinforcement. The shaft 13 has a lower shaft portion 26 and an elongated main shaft portion 27 which is only partially shown. The elongated main shaft portion 27 terminates in a grip (not shown) that allows the golfer to grasp the golf club 11.

As best seen in the sectional view of FIG. 3, the club head 11 is provided with a straight hole 28 bored in the wood club head 12 that extends inwardly in the general direction of the center of percussion 23 at an angle "a" of approximately 40 degrees with the horizontal ground level 22. Angle "a" could vary from 35 degrees to 45 degrees depending on the design and shape of the club head 12. The bored hole 28 usually ends at a point just below the center of percussion 23.

The direction of the hole 28 to be bored into the club head 11 is selected so that the axis of the hole 28 and the center axis 31 of the lower shaft portion 26 received therein lie in a vertical plane that is substantially parallel to a second vertical plane extending through a horizontal line 33 which is tangent to the generally convex-curved striking face 17 at its forwardmost part of the club head 12 as seen in FIG. 1.

The center axis 31 of the lower shaft portion 26 is angularly offset from the center axis 32 of the elongated main shaft portion 27 at the bend 29 by an angle "b" as best seen in FIG. 3. Angle "b" is approximately 15 degrees but also can vary depending on the design configuration of the club head 12. The center axis 32 of the main elongated shaft 27 if extended downwardly would make an angle "c" with the horizontal ground level 22 of about 55 degrees when the golf club head 12 is supported by the ground at ground level 22 and held in a ready-to-swing position by the golfer but this angle again could vary between 50 degrees and 60 degrees. The lower shaft portion 26 is inserted into the bored hole 28. The lower shaft portion 26 extends to the outside of the club head 11 so that the bend 29 is external of the neck 24 of the golf club head. Adhesive 34 in a viscous state is applied into the bored hole 28 and/or onto the lower shaft portion 26 before the lower shaft portion 26 is inserted for assembly in order to permanently bond the shaft 13 to the club head 12 after the adhesive 34 has set up.

In FIGS. 1, 2 and 3, the preferred embodiment of this invention shows that the lower shaft portion 26 comprises a stub shaft 35 and a sleeve 36 encompassing the stub shaft 35. The sleeve 36 can be made out of metal tubing that slides onto the stub shaft 35. The stub shaft 35 also could be made integrally with or be an extension of the elongated main shaft portion 27 of the shaft 13. The sleeve 36 received on the stub shaft 35 can be bent together to be angularly offset from the main elongated shaft portion 27 so as to become the lower shaft portion 26 that is inserted into the bored hole 28 of the club head 12. The sleeve 36 extends beyond the stub shaft 35 to also encompass the lower segment of the elongated main shaft portion 27 to protect the shaft 13 at the point where the bend 29 is formed. By bending the lower segment of the shaft 13 and the sleeve 36 together, these pieces become interlocked to become an integral unitary structure for the lower shaft portion 26. Although the sleeve 36 is the preferred embodiment, it is not absolutely required as the lower shaft portion 26 and the main elongated shaft portion 27 can be bent from a single straight metal shaft with an angular offset stub shaft 35 then directly received in the bored hole 28.

Figure 4:
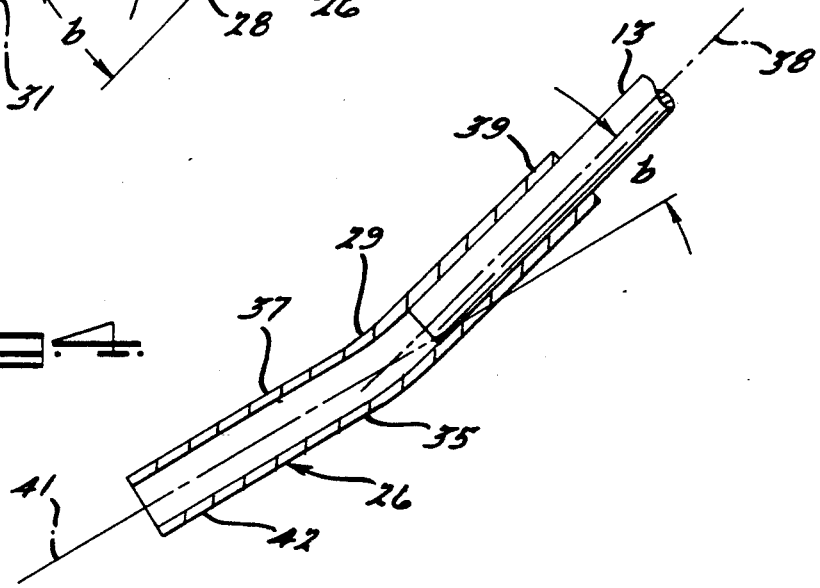
FIG. 4 is a cross-sectional view of a part of an alternative embodiment of this invention.

In FIG. 4, a further embodiment of this invention is illustrated depicting only the lower shaft portion 26 that incorporates an alternative construction. At times the shaft 13 is fabricated from a lighter material than steel such as boron or graphite. These materials cannot be readily bent. To overcome this deficiency, the construction of the lower shaft portion 26 as seen in FIG. 4 has been developed. A sleeve 37 or steel tubing is bent so that the center axis 38 of the upper portion 39 of the sleeve 37 is angularly displaced from the center axis 41 of the lower portion 42 of the sleeve 37 by angle "b" which is about 15 degrees but can range from 10 degrees to 20 degrees. The upper portion 39 of the sleeve 37 receives the bottom segment of the straight shaft 13. The lower portion 42 of the sleeve 37 is equivalent in function to the lower shaft portion 26 of the embodiment shown in FIGS. 1, 2 and 3 and provides for the interconnection of the shaft 13 to the golf club head 12.

Figure 5:
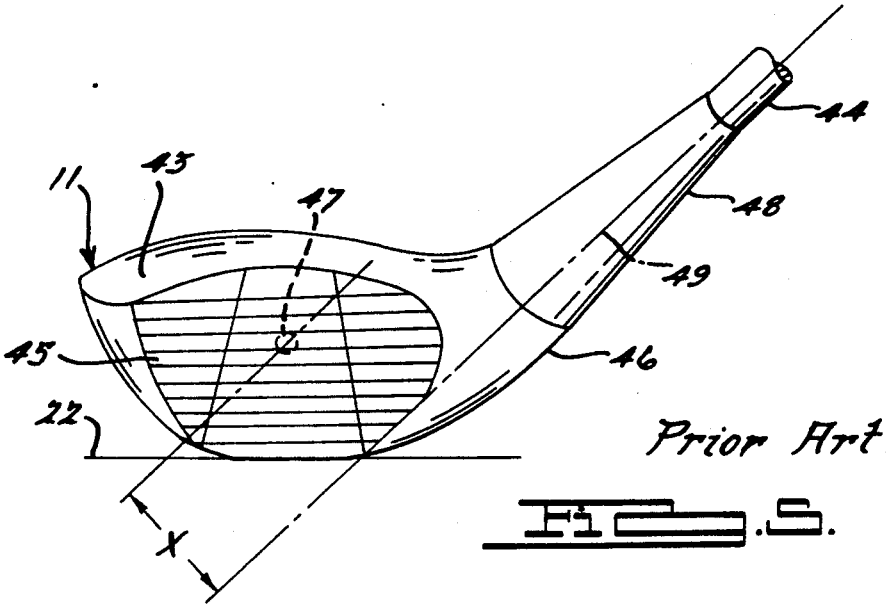
Prior Art FIG. 5.
FIG. 5 is a frontal view of a conventional wood golf club of the prior art.

FIG. 5 shows a conventional golf club head 43 and a straight shaft 44 as known in the prior art. The golf club head 43 is provided with a striking face 45 and heel portion 46. The "sweet spot" 47 shown as a dotted circle in FIG. 5 is located in the center of the striking face 45 of the club head 43. A hollow hosel 48 extends at an angle upwardly and rearwardly of the heel portion 46 with the center axis 49 of the hosel 48 making an angle of about 55 degrees with the horizontal ground level 22 when the club head 43 is resting on the ground at ground level 22 held in a ready-to-swing position by the golfer. The bottom segment of the straight shaft 44 is received within the hosel 48 and bonded thereto with the center axis 49 of the hosel 48 and the shaft 44 extended in a downward direction as shown in FIG. 5. It can be seen that the distance "x" from the "sweet spot" 47 along a line normal to the center axis 49 is about 1 inch (2.54 cm.). The distance or dimension "x" results in a force couple when the golf club head 43 of a conventional golf club is swung by the golfer to make contact with the golf ball at the "sweet spot" 47 resulting in a relatively violent force reaction, especially if the golf ball is hit off center. The golfer will try to compensate for this anticipated force reaction transmitted through the shaft 13 to improve the accuracy of flight of the golf ball.

As again seen in FIG. 3, in the golf club 11 of this invention, the distance "y" measured at normal from the "sweet spot" 23*a* to the center axis 31 of the lower shaft portion 26 is substantially less than the distance "x" of the conventional golf club head 43 as seen in FIG. 5. Distance "y" is less than ½ inch (1.27 mm) and could be theoretically down to zero depending on the club head configuration. This allows for the masses contributed by the lower shaft portion 26 and its surrounding structure and the corresponding counterbalanced mass to be positioned closer to the center of percussion 23.

An assembly method is possible with the construction of the golf club 11 of this invention which offers additional important and unique advantages.

As seen in FIGS. 1, 2 and 3, after adhesive 34 is applied to the lower shaft portion 26, but before the adhesive 34 has set-up and after the lower shaft portion 26 is inserted in the bored hole 28 of the club head 12, the shaft 13 can be freely rotated in the hole 28.

Slight rotation of the shaft 13 at the grip when the golf club 11 is held in ready-to-swing position by the golfer and the club head 12 is resting on a flat surface will cause the club head 12 to slightly swivel around its forwardmost part, which is substantially near or at the center of the convex-curved striking face 17. This is due to the angular offset of the lower shaft portion 26 from the main elongated shaft portion 27 to which the grip is attached. Rotation of the main elongated shaft portion 27 results in the pivotal movement of the lower shaft portion 26 about bend 29 which is positioned external of the club head 12. The face angle; the striking face 17 changes its position to an open or closed position when the club head 12 swivels. When the face angle is in the desired pre-selected position, the golf club 11 is maintained in a fixed position, preferably in a fixture, until the adhesive 34 sets-up.

Figure 6:
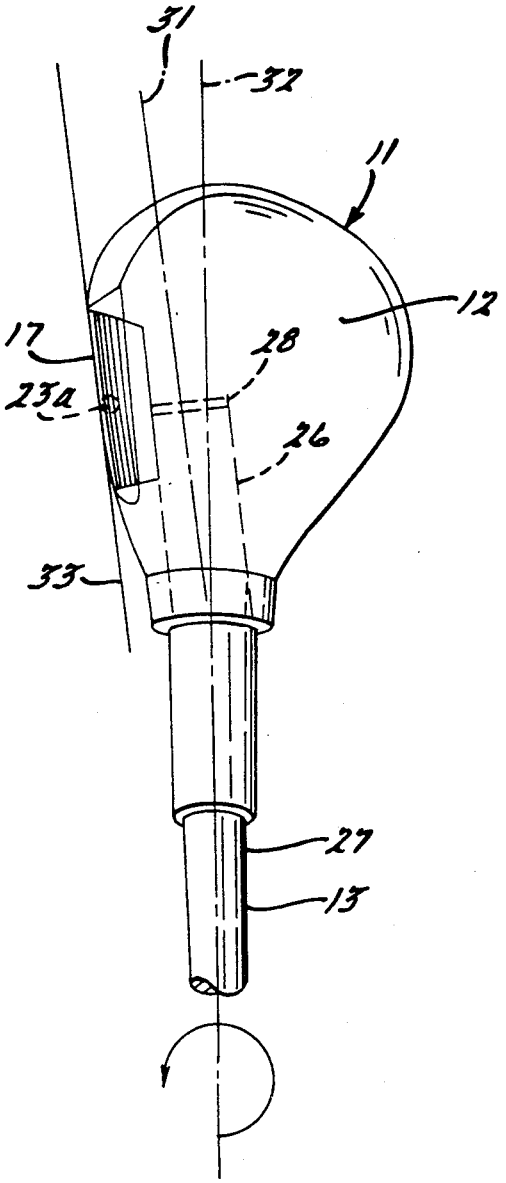
FIG. 6 is a top view of the golf club of this invention at time of assembly with the face angle of the club head in a closed position.
Figure 7:
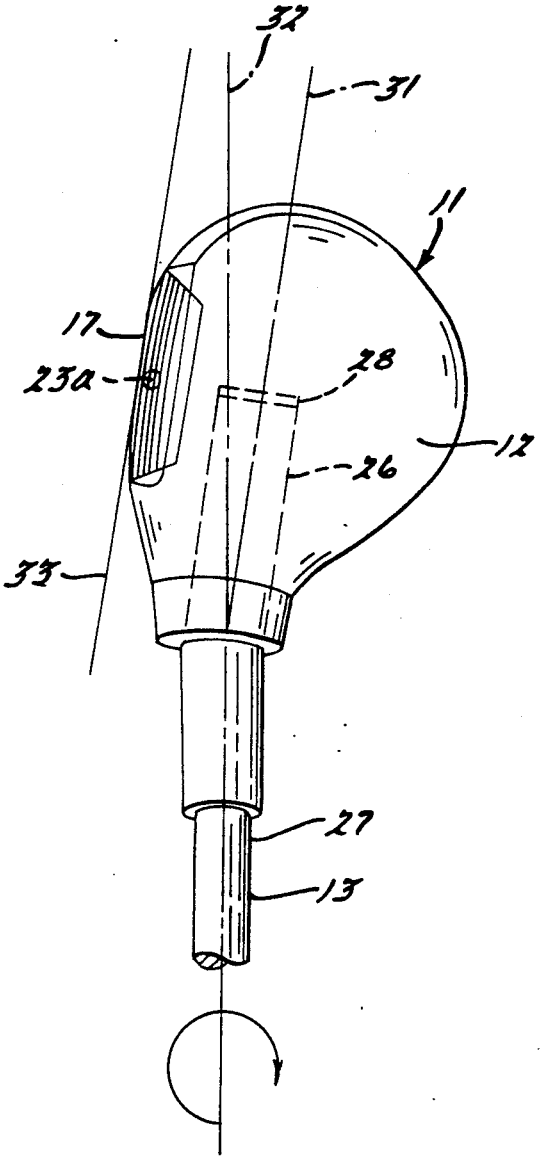
FIG. 7 is a top view of the golf club of this invention at time of assembly with the face angle of the club head in an open position.

As seen in FIGS. 6 and 7 depicting top views of the golf club 11 of this invention, the face angle is shown in a closed and open position respectively. The face angle can be defined as the angle made by a horizontal line 33 tangent to the forwardmost part substantially at or near the center of the convex-curved striking face 17 with the horizontal center axis 49 of the main shaft 13 and club head 11 when viewed from above.

When a golfer tends to hook or slice the golf ball, he tries to choose a face angle for the striking face 17 of the club head 12 that works in concert with his swing to allow the striking face 17 to hit the ball with greater accuracy. Conventional prior art golf clubs, especially "woods" have the face angle permanently factory machined or molded into the club head 12 at the time of manufacture. Each golfer varies his stance to compensate for his golf game but a built-in face angle into the club head 12 will limit the compensation a golfer need apply to improve his golf game.

In the golf club 11 of the present invention, the golfer can have the face angle set at a position to meet his own particular needs to reduce the compensation he otherwise would require.

As seen in FIG. 6, rotation of the shaft 13 in a counterclockwise direction as indicated by the arrow will swivel the club head 12 to rotate the face angle of the striking face 17 to a closed position. The center axis 31 of the lower shaft portion 26 is now angularly displaced from the center axis 32 of the main elongated shaft portion 27. The vertical plane, in which the center axis 31 of the lower shaft portion 26 lies, is always maintained in a parallel relationship with a second vertical plane passing through horizontal line 33 tangent to the striking face 17 at the forwardmost part substantially at or near the center thereof or the "Sweet Spot" 23*a*.

In FIG. 7 rotation of the shaft 13 in a clockwise direction as indicated by the arrow will rotate the face angle of the striking face 17 to an open position about the forwardmost part of the club head 12.

When the horizontal tangent line 33 is absolutely parallel with the horizontal center axis 49 as seen in FIG. 1, the face angle is in a neutral position. Only very slight rotation of the shaft 13 in either direction is required to change the face angle.

Once the face angle position desired by the golfer is achieved, the club head 12 and the shaft 13 are maintained in a fixed position until the adhesive 34 sets-up as previously described to form a firm interconnection between the shaft 13 and the club head 12 as best seen in FIGS. 1, 2 and 3.

If, at a later time, the golfer desires to change the face angle of the striking face 17 of the golf club 11 of this invention, the bond of the adhesive 34 can be broken by applying heat and the assembly method repeated after the golfer rotates the shaft 13 which, in turn, pivot the lower shaft portion 26 in the bored hole 28 about the bend 29 to cause the club head 12 to swivel in order to establish a different face angle setting to suit.

While only certain embodiments of the present invention have been described, others may be possible without departing from the scope of the appended claims.

I claim:

1. A method of assembly for a golf club, said golf club comprising a golf club head and a shaft, said golf club head having a convex-curved striking face and a hole for receiving the shaft extending inwardly at an angle, said golf club head having a forwardmost part substantially at the center of said striking face, the center axis of said hole lying in a vertical plane substantially parallel with a second vertical plane tangent to the forwardmost part of said golf club head, said shaft having a main elongated shaft portion at one end, a lower shaft portion at the other end and a bend therebetween, said bend angularly offsetting said lower shaft portion from said main elongated shaft portion by 10–15 degrees, the steps of assembly comprising:

(a) Applying a viscous adhesive to said lower shaft portion, (b) Inserting said lower shaft portion into said hole of said golf club head while maintaining said bend external of said golf club head, (c) Rotating said main elongated shaft portion slightly while the adhesive is still viscous to cause pivotal movement of said lower shaft portion about said bend, said pivotal movement causing said golf club head to swivel about said forwardmost part to move the face angle of said striking face to a pre-selected open or closed position, and (d) Maintaining said golf club head and shaft firmly in the pre-selected position until the adhesive sets up to interconnect said shaft to said golf club head with the face angle of said striking face in the pre-selected position.

2. The method of assembly of claim 2 wherein rotating said main elongated shaft portion in a clockwise direction moves the face angle of said striking face to an open position.

3. The method of assembly of claim 1 wherein rotating said main elongated shaft portion in a counter clockwise direction moves the face angle of said striking face to a closed position.

4. A method of assembly for a golf club, said golf club comprising a golf club head and a shaft, said golf club head having a convex-curved striking face, a center of percussion, and a hole for receiving the shaft extending inwardly at an angle in the general direction of said center of percussion, said golf club head having a forwardmost part substantially at the center of said striking face, the center axis of said hole lying in a vertical plane substantially parallel with a second vertical plane tangent to the forwardmost part of said golf club head, said shaft having a main elongated shaft portion at one end, a lower shaft portion at the other end and a bend therebetween, said bend angularly offsetting said lower shaft portion from said main elongated shaft portion by 10 to 15, the steps of assembly comprising:

(a) Applying a viscous adhesive to said lower shaft portion, (b) Inserting said lower shaft portion into said hole of said golf club head while maintaining said bend external of said golf club head, (c) Rotating said main elongated shaft portion slightly while the adhesive is still viscous to cause pivotal movement of said lower shaft portion about said bend, said pivotal movement causing said golf club head to swivel about said forwardmost part to move the face angle of said striking face to a pre-selected open or closed position, and (d) Maintaining said golf club head and shaft firmly in the pre-selected position until the adhesive sets up to interconnect said shaft to said golf club head with the face angle of said striking face in the pre-selected position.

5. A golf club made by the method of any of claims 2, 3, 1 or 4.

* * * * *